United States Patent [19]

Martin

[11] Patent Number: 4,906,133

[45] Date of Patent: Mar. 6, 1990

[54] MINING APPARATUS FOR UTILIZATION IN RECOVERING COAL

[76] Inventor: J. Scott Martin, 416 Park Pl., Lexington, Ky. 40505

[21] Appl. No.: 286,328

[22] Filed: Dec. 19, 1988

[51] Int. Cl.[4] ..... F21D 15/30

[52] U.S. Cl. ..... 405/289; 405/291; 405/302

[58] Field of Search ..... 405/289, 291, 302; 299/1

[56] References Cited

U.S. PATENT DOCUMENTS

| | | | |
|---|---|---|---|
| 2,795,936 | 6/1957 | Blower et al. | 405/300 |
| 4,281,876 | 8/1981 | Lansberry | 299/1 |
| 4,452,075 | 6/1984 | Bockhorst et al. | 299/1 |
| 4,462,637 | 7/1984 | Rafael et al. | 299/32 |
| 4,490,076 | 12/1984 | Allen | 405/289 |
| 4,523,514 | 6/1985 | Burk | 92/5 R |
| 4,676,697 | 6/1987 | Stafford et al. | 405/291 |

FOREIGN PATENT DOCUMENTS

| | | | |
|---|---|---|---|
| 540044 | 12/1976 | U.S.S.R. . | |
| 605980 | 5/1978 | U.S.S.R. | 405/289 |
| 621886 | 8/1978 | U.S.S.R. | 405/289 |
| 641117 | 1/1979 | U.S.S.R. . | |
| 861635 | 9/1981 | U.S.S.R. | 405/289 |
| 875073 | 10/1981 | U.S.S.R. . | |
| 1357582 | 12/1987 | U.S.S.R. | 405/289 |

*Primary Examiner*—Randolph A. Reese
*Assistant Examiner*—Arlen L. Olsen
*Attorney, Agent, or Firm*—King & Schickli

[57] ABSTRACT

A mining apparatus for utilization in recovering coal includes a series of four cooperating legs: a right fore leg, left fore leg, right rear leg and left rear leg. Each leg is formed from a box-like shield. An inflatable bag is provided in each leg. When a particular bag is inflated, the bag expands extending the leg between the floor and roof of the mine. When deflated, the leg retracts. A series of hydraulic rams connect the legs together. These rams may be expanded and retracted as desired to move the support legs relative to one another. In this way the apparatus may be moved in substantially any direction about a 360° arc. A microprocessor controller controls the operation of the apparatus. In accordance with further aspects of the invention, a number of mining apparatus of the type described may be connected together in series to form a line for roof support. In addition, one or more of the apparatus may be connected to a coal conveyor or other mining equipment such as a pneumatic breaker to provide propulsion.

14 Claims, 6 Drawing Sheets

FIGURE 1
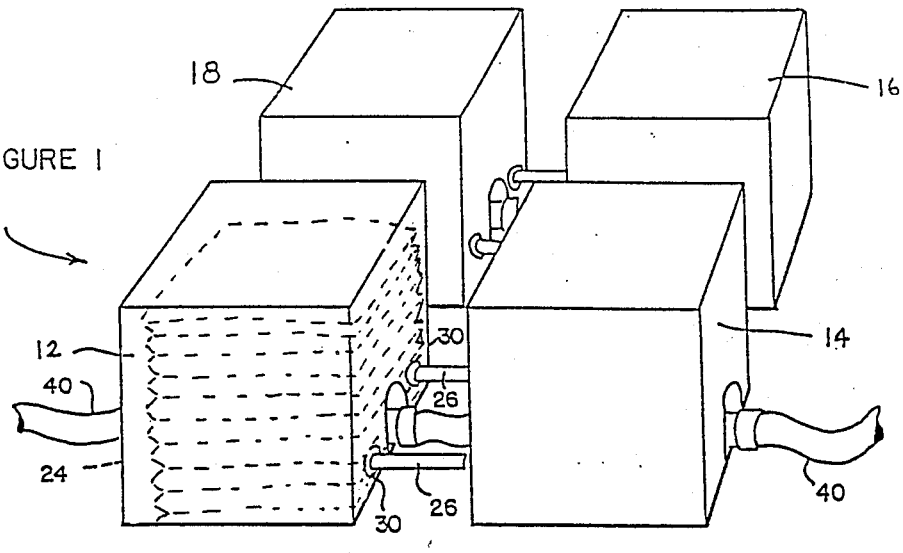
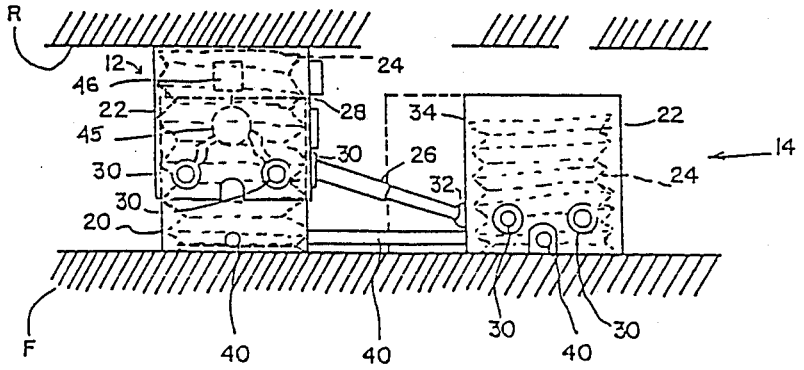
FIGURE 2

MINING APPARATUS FOR UTILIZATION IN RECOVERING COAL

TECHNICAL FIELD

The present invention relates generally to the art of mining and, more particularly, to an improved mining apparatus for utilization in recovering coal from a coal seam. The versatile apparatus may be utilized strictly as a roof support but is also adapted for conveying a coal cutter and/or a coal face conveyor.

BACKGROUND OF THE INVENTION

Coal is formed over time from decomposed and compressed organic matter. Coal is typically found in substantially horizontal seams extending between sedimentary rock strata such as limestone, sandstone or shale. Depending upon the position of the coal relative to the surface topography, surface and underground mining techniques are primarily utilized to recover this coal.

Surface or strip mining involves the removal of material, known as overburden, overlying a coal seam so as to expose the coal for recovery. In recent years, surface mining has gained prominence over underground mining in the United States. This is due to many factors including: (a) the increased material moving capacity of surface or strip mining equipment; (b) lower costs for surface mining than underground mining; (c) the better safety record of surface mining versus underground mining; (d) a higher coal recovery percentage for surface mining versus underground mining and (e) many coal reserves favor extraction by surface mining due to geological factors.

Despite these advantages, applications of surface mining are limited. The primary limiting factor is the depth of overburden. More particularly, the greater the depth the coal seam is below the surface, the greater the amount of overburden that must be removed to reach the coal. Eventually, the depth becomes so great that strip mining is simply economically unfeasible.

Where this occurs, large quantities of coal may still remain in the ground. A need therefore exists for mining methods that may be utilized for the economic recovery of this coal. Underground mining applications in such an instance are very limited. A number of factors are responsible for this including the possible existence of poor roof support conditions, the thinness of the seam and/or the presence of insufficient quantities of coal to warrant the large capital investments characteristic of underground operations.

As a result, auger mining has often been utilized in the past to recover coal following a strip mining operation. Advantageously, auger mining requires a relatively low capital expenditure when compared to either surface or underground mining. It also may be activated quickly and is very efficient providing more tons per man day than any other form of mining.

In auger mining, an auger is used to bore into the face of the seam and recover coal from beneath the overburden. It may be utilized in relatively thin seams and is safer than both surface or underground mining while also providing a generally cleaner coal product.

Despite all these advantages, however, auger mining suffers from a number of drawbacks that have left the coal industry looking for still another alternative to use in recovering coal left in the ground following strip mining. More particularly, despite the high rate of production, auger mining provides a relatively low total coal recovery. Lost coal recovery takes two main forms. In one instance, pillars of coal must be left standing between adjacent auger holes in order to support the overburden. In another instance, the penetration depth of augers is limited as augering equipment characteristically drills holes that sag downwardly gradually with increasing depth of penetration into the coal seam. In fact, holes drilled with conventional auguering equipment are usually only of a depth of 150 feet with 200 feet being rarely obtainable. Thus, any coal beyond this distance is not recoverable with auger equipment. As such, coal recovery for a resource area being augered is usually less than about 35%.

A need therefore exists for an improved mining apparatus that may be utilized to efficiently recover coal following a strip mining operation where the overburden becomes too costly to remove. Preferably, the apparatus is also effectively adapted for recovering coal from relatively thin seams. In addition, the apparatus could be utilized to increase coal recovery in underground mining operations by safely recovering the coal in pillars normally left behind in a room and pillar mining operation. In this way, the apparatus may be effectively utilized to increase the total coal recovery under any number of circumstances and conditions in a relatively cost efficient manner.

SUMMARY OF THE INVENTION

Accordingly, it is a primary object of the present invention to provide an improved mining apparatus or system overcoming the above-described limitations and disadvantages of the prior art.

Another object of the present invention is to provide a highly productive mining apparatus that is less labor intensive and may be remotely operated for increased mining safety.

A further object of the present invention is to provide a mining apparatus and system that may in certain situations be utilized as a substitute for surface mining. Advantageously, the apparatus and system produce less environmental damage while providing coal recovery rates equivalent to strip mining.

Still another object of the invention is to provide a coal mining apparatus that is relatively inexpensive to build and operate while allowing a high rate of coal recovery in a safe and effective manner.

Yet another object of the present invention is to provide a coal mining apparatus that may be especially adapted for remote operation to recover coal from relatively thin seams where recovery costs may have prohibited mining of reserves in the past.

Still another object of the invention is to provide a versatile mining apparatus adapted to provide not only roof support but also convey a coal mining/cutting apparatus and/or coal conveyor in any direction about a 360° arc as desired.

Additional objects, advantages and other novel features of the present invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved apparatus is provided for mining coal. The apparatus includes a series of cooperating support legs. More particularly, the apparatus includes four support legs: a left foreleg, right foreleg, left rear leg and right rear leg. Means is also provided for selectively extending and retracting the support legs. Thus, each leg may be individually extended from the floor to the roof of the coal seam. In addition, means is provided for moving the support legs relative to one another so that the apparatus may be directly moved in substantially any selected direction about a 360° arc. This allows the apparatus to be moved through the seam and along the coal face as desired by the operator. Further, since the means for controlling the operation of the apparatus may be remotely located, the operator may control the apparatus from a relatively safe position away from the danger of a roof fall or other potential hazard.

More specifically, each support leg includes an inflatable bag that is positioned within an expansible, box-like shield. Preferably, this shield is made of steel plating which protects the inflatable bag from damage that might otherwise be incurred through high pressure contact with jagged rock formations along the floor and roof of the mine.

A pressurized fluid source and a fluid flow control means in the form of a series of valves operate in response to the controller to inflate and deflate the bags in each support leg as required. As a bag is inflated, it expands and the leg is extended firmly between the floor and roof of the mine so as to support the roof. Conversely, as a bag is deflated, the telescoping box-like shielding contracts, moving away from the mine roof.

The means for selectively moving the legs relative to one another comprises a series of four pairs of actuators. The first of these actuator pairs connects the left and right forelegs. The second connects the right fore and rear legs. The third connects the left and right rear legs and the fourth connects the left fore and rear legs. Preferably, the actuators are in the form of hydraulic rams. A second pressurized fluid source and second series of control valves responsive to the controller are connected to these hydraulic rams. As will be described in greater detail below, by extending and retracting particular legs and actuating the hydraulic rams in a particular manner, the apparatus may be manipulated so as to move in substantially any direction about a 360° arc.

In accordance with yet another aspect of the present invention, a number of the present apparatus may be connected together to form a line for roof support as, for example, along a coal face, such as a longwall face, from which coal is being recovered. Under these circumstances, it is important to be able to sense the relative position of each mining apparatus in the group. Means are, therefore, provided for this purpose. More specifically, the position sensing means includes a telescoping connecting wand that is connected to adjacent mining apparatus by means of ball joint or U-joint connectors. Sensors are provided for sensing the length, vertical angle and horizontal angle of the wand. This information is then fed to the controller. There this information is processed to determine the exact relative position of the adjacent individual mining apparatus and coordinate their movements.

In accordance with still another aspect of the present invention, specific mining machinery may be connected to the mining apparatus so as to form, for example, a self-propelled coal conveyor or coal winning apparatus. More particularly, a coal face conveyor may be connected between two or more of the apparatus which can be utilized to move the conveyor into position along the face as mining operations advance through the seam. Alternatively, a coal winning or cutting means such as, for example, a continuous miner head, pneumatic hammer or pneumatic breaker may be mounted to one of the forelegs of the apparatus. The apparatus may then be utilized to advance the device into and along the seam so as to recover coal. In order to ensure that the apparatus is being operated in the most efficient manner, a TV camera or gamma ray detector may be connected to the apparatus to detect the seam face as well as the floor and roof of the seam. In this way, the mining apparatus may be guided and maintained in the seam for maximum efficiency in recovering coal.

Still other objects of the present invention will become readily apparent to those skilled in this art from the following description wherein there is shown and described a preferred embodiment of this invention simply by way of illustration of one of the modes best suited to carry out the invention. As it will be realized, the invention is capable of other different embodiments and its several details are capable of modifications in various, obvious aspects all without departing from the invention. Accordingly, the drawings and descriptions will be regarded as illustrative in nature and not as descriptive.

BRIEF DESCRIPTION OF THE DRAWING

The accompanying drawing incorporated in and forming a part of the specification, illustrates several aspects of the present invention, and together with the description serves to explain the principles of the invention. In the drawing:

FIG. 1 is a perspective view of the mining apparatus of the present invention;

FIG. 2 is a sectional view of the apparatus taken along line II—II of FIG. 4;

Figure 3:
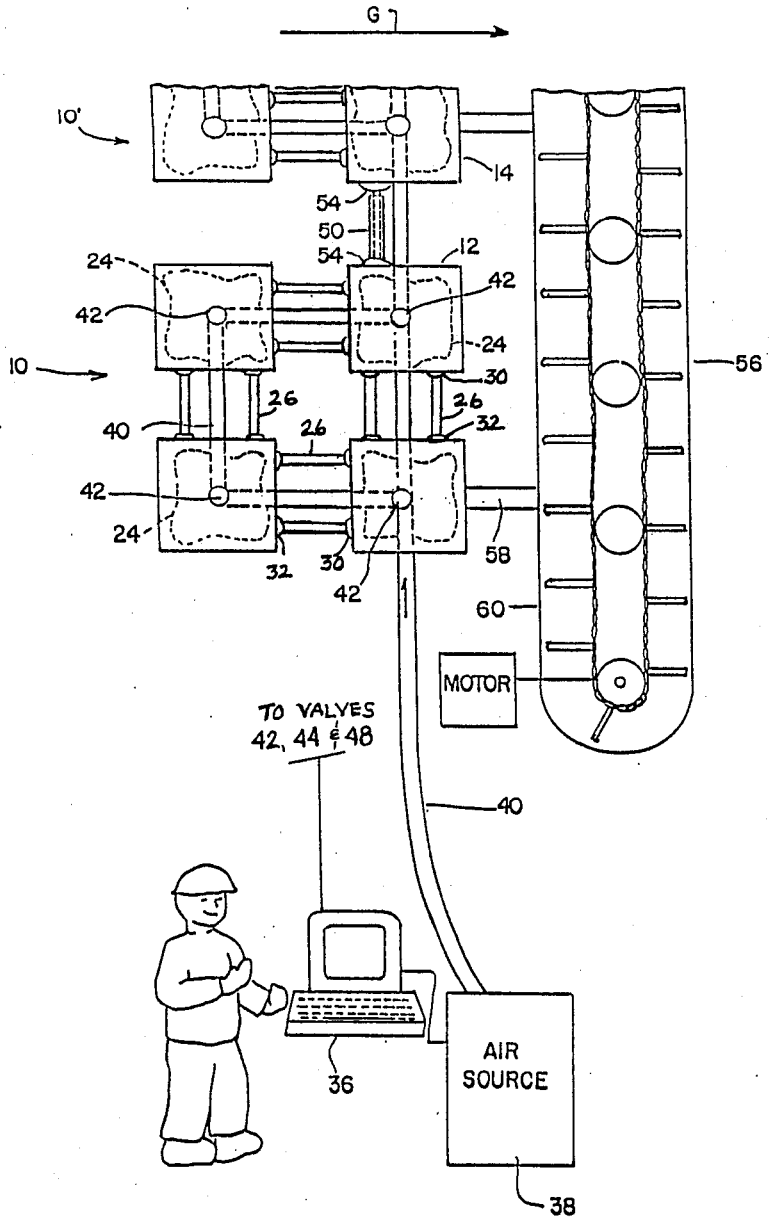
FIG. 3 is a schematical representation showing the remote operation of the apparatus of the present invention.

Reference will now be made in detail to the present preferred embodiment of the invention, an example of which is illustrated in the accompanying drawing.

DETAILED DESCRIPTION OF THE INVENTION

Reference is now made to FIG. 1 showing the mining apparatus 10 of the present invention. As shown, the apparatus 10 includes a series of four cooperating support legs 12, 14, 16 and 18. Each leg 12, 14, 16, 18 comprises an expansible box-like shield including a bottom half 20 having four sidewalls and a bottom wall and a top half 22 having four sidewalls and a top wall. As best shown in FIG. 2, the bottom half 20 is received in sliding engagement within the top half 22.

Mounted within each box-like shield 20, 22 is an inflatable bag 24. As shown in FIG. 2, when the bag 24 is inflated (note left side of figure), it extends the top half of the shield 22 upwardly into engagement with the roof R of the mine so that the leg 12 supports the roof. Alternatively, when the bag 24 is deflated (note right side of figure), gravity draws the top half 22 of the shield downward over the lower half 20 away from the roof R. Thus, by inflating and deflating the bag 24, each individual leg 12, 14, 16, 18 may be extended and retracted so as to engage and support the roof R of the mine as desired. Further, it should be appreciated that the shield 20, 22 may be made of steel so as to protect the bags 24 from direct contact with the rock formations of the mine floor and roof. Thus, the possibility of a bag 24 being snagged and/or punctured on a jagged rock formation is avoided. Consequently, the reliable and dependable performance of the apparatus 10 of the present invention is assured.

As also shown in FIGS. 1, 3, 4 and 5, each leg 12, 14, 16, 18 of the mining apparatus 10 is attached to an adjacent leg by means of a pair of actuators, preferably, in the form of hydraulic rams 26. For example, as shown in FIG. 2, the rams 26 (only one visible in the figure) are connected to the sidewall 28 of the upper shield half 22 of the leg 12 through universal joints 30. The opposite ends of the rams 26 are connected to the leg 14 by means of universal joints 32 secured to the sidewall 34 of the upper shield half 22 of leg 14. As shown, a pair of rams 26 are connected in like manner between the legs 14 and 16, 16 and 18 and 12 and 18 respectively. By extending and retracting the legs 12, 14, 16 and 18 in a particular manner in conjunction with the operation of the rams 26 which move the legs relative to one another, the apparatus 10 may be moved in substantially any selected direction about a 360° arc.

Figure 6:
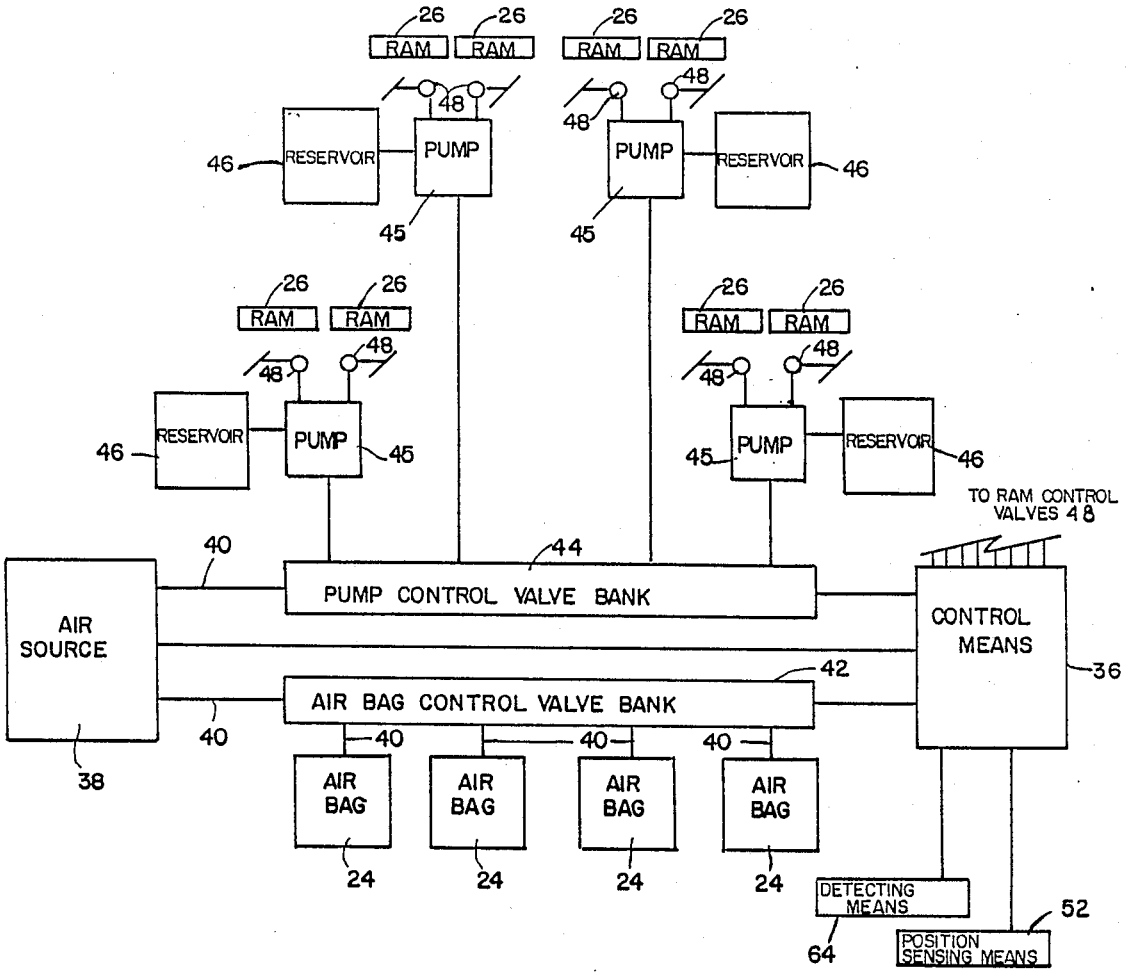
FIG. 6 is a schematic control diagram for the apparatus.

Operational control of the apparatus is provided through a control means, such as a microprocessor controller 36 (see FIGS. 3 and 6) which may include a CRT monitor and keyboard for operator input. As schematically shown in FIG. 3, the microprocessor 36 may be positioned remote from the mining apparatus 10 as, for example, in an open area away from the high wall for improved miner safety. The microprocessor 36 is connected to an air source such as an air compressor 38. As shown in FIG. 3, the air compressor 38 is connected through a pressure line 40 to a series of three-way air bag control valves 42. A total of four air bag control valves 42 are connected to each apparatus 10, one valve for each bag 24 in each leg 12, 14, 16, 18. The valves 42 operate in response to the microprocessor 36 and may be selectively opened to inflate an associated bag 24 and extend any individual leg 12, 14, 16, 18 as desired. Alternatively, the valves may be moved to an exhaust position to exhaust the air in any individual bag 24 and, thereby, retract any particular leg 12, 14, 16, 18 of the apparatus 10 from the roof R of the mine.

The microprocessor controller 36 is also connected to a series of pump control valves 44. More particularly, four pump control valves 44 are provided with each apparatus 10. When opened, a pump control valve 44 serves to feed pressurized air from the line 40 so as to drive a pneumatic pump 45 associated with that particular valve. One pump 45 is provided for each pair of hydraulic rams 26 extending between adjacent legs 12, 14, 16, 18. When activated, the pump 45 serves to pump hydraulic fluid from a reservoir 46 through a ram control valve 48 to one end of the associated rams 26 so as to retract or extend the rams and therefore move the adjacent legs 12, 14, 16, 18 of the apparatus 10 relative to one another. In this way, the apparatus 10 may be moved in substantially any direction as will be described in greater detail below.

Figure 4:
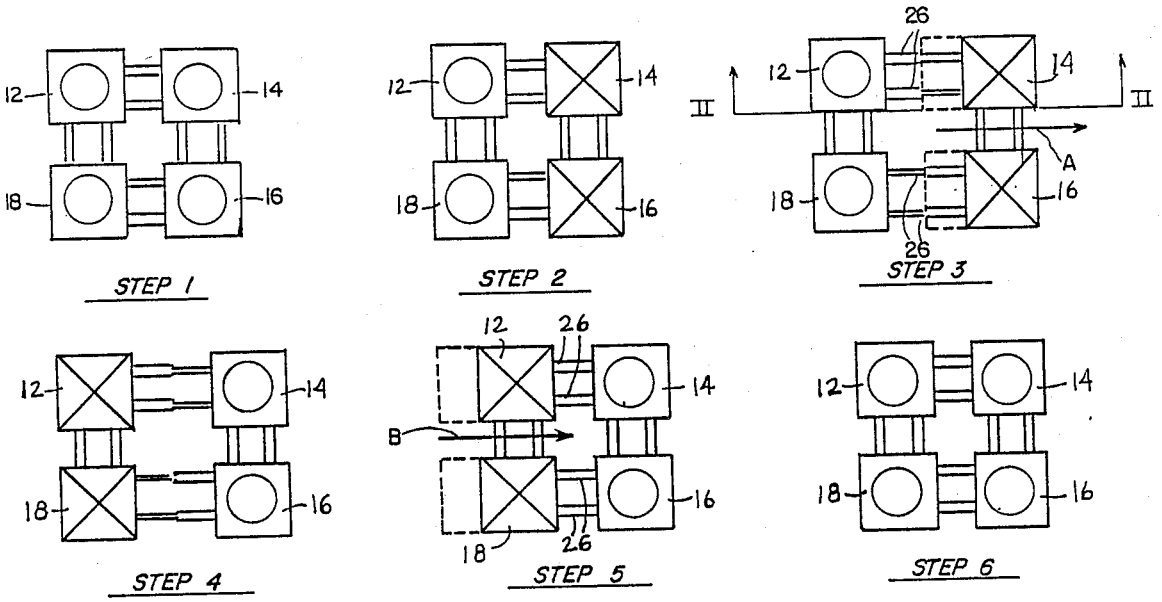
FIG. 4 is a diagrammatical representation showing the linear movement of the apparatus of the present invention.

Movement of the apparatus 10 in a linear direction either forward, backward, to the left or right is described below with reference to FIG. 4. As shown in step 1, all four legs 12, 14, 16, 18 are fully extended so as to engage and support the mine roof R (note extended legs are designated by a "0"). In order to move to the right, the right fore and rear legs 14 and 16 are retracted. More specifically, the microprocessor 36 operates the three-way flow control valve 42 so as to exhaust air from the bags 24 associated with the legs 14 and 16, thereby causing the legs 14, 16 to retract and disengage from the mine roof R (retracted legs are designated by a "X"). Once the legs 14 and 16 are retracted from the roof, the rams 26 connecting fore leg 12 to fore leg 14 and rear leg 18 to leg 16 are extended.

Figure 6C:
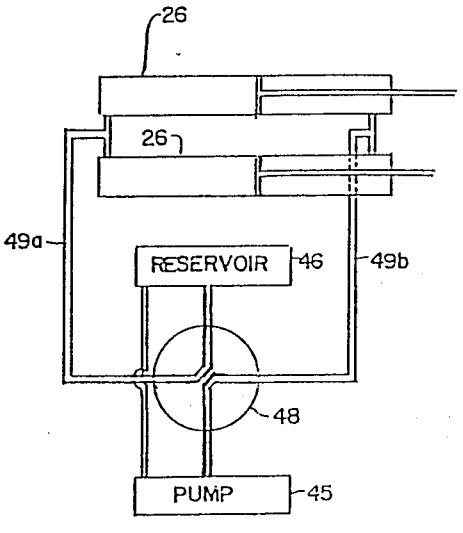
FIGS. 6A–6C schematically show the operation of the solenoid ram control valves of the apparatus.
Figure 6B:
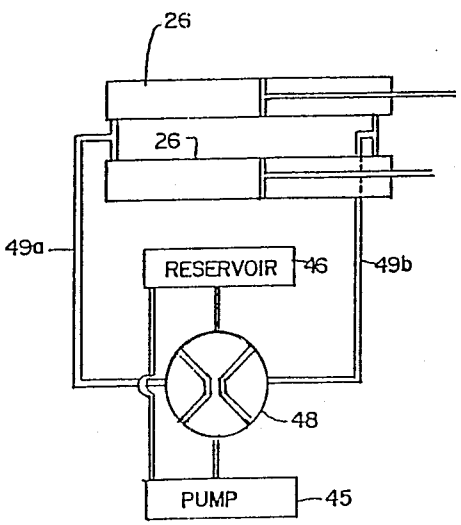
Figure 6A:
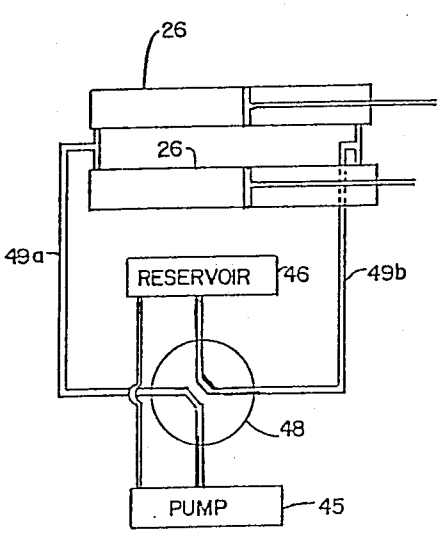

More specifically, the microprocessor controller 36 opens the desired pump control valves 44 so as to actuate the hydraulic pumps 45 providing pressurized fluid to these rams 26. In addition, the controller 36 also actuates the solenoid ram control valves 48 to move them to the position shown in FIG. 6A. In this position hydraulic fluid from the pump 45 is fed along line 49*a* to the left side of the rams 26 which are extended. As the rams 26 are extended, the legs 12 and 18 firmly extended between the floor F and roof R of the mine are held in a stationary position. The retracted legs 14 and 16 are, however, pushed in the direction of action arrow A from their original position (note dotted line outline) to a new position further to the right (note full line position). Once the legs 14 and 16 have been moved to the right the desired distance as measured, for example, by a position sensor (not shown), the microprocessor 36 activates the ram control valves 48 to move them to the closed position shown in FIG. 6B, thereby freezing the rams 26 in position. Substantially simultaneously, the valves 44 are closed to shut down the associated pumps 45. Then the air bag control valves 42 associated with the legs 14, 16 are activated so as to cause the flow of pressurized air from line 40 into the inflatable bags 24 in the legs 14 and 16. The legs 14 and 16 are then extended to engage between the floor F and roof R of the mine. The air bag control valves 42 associated with the legs 14 and 16 are then closed to maintain those legs in position.

Next, the valves 42 associated with the legs 12 and 18 are moved to their exhaust position and thus, those legs are retracted. The rams 26 extending between the legs 12 and 14 and 18 and 16, respectively, are then retracted (see step 5) by opening the valves 44 to start the pumps 45 associated with those rams. Substantially simultaneously, the solenoid valve 48 is moved to the position shown in FIG. 6C to pressurize the right side of the rams 26 through the line 49*b*. With the left side of the rams 26 connected to the reservoir through the line 49*a*, the rams are then retracted. Since the legs 14 and 16 are fully extended between the floor F and roof R of the mine, these legs remain stationary. The retracted legs 12 and 18, however, move to the right in the direction of action arrow B from their original position (note dashed line outline) to their new position (note full line outline). Upon reaching the desired position, the ram control valve 48 is moved to the closed position (see FIG. 6B).

Substantially simultaneously the valves 44 are closed to shut down the pumps 45. With the legs 12, 18 now in position, the bags 24 in those legs are inflated so that the legs 12, 18 also fully extend between the floor F and roof R of the mine like the legs 14 and 16.

As should be appreciated, movement to the left, in the forward direction or in the reverse direction may be accomplished in substantially the same manner, but by operating different legs together. For example, forward movement may be completed by first retracting the fore legs 12 and 14. These legs 12, 14 are then moved toward the top of the drawing by extending the rams 26 connecting legs 12 and 18 and legs 14 and 16 respectively. After the rams 26 are fully extended, the fore legs 12 and 14 are reextended to engage the floor F and roof R of the mine. Rear legs 16 and 18 are then retracted as are the rams 26 so that those legs are moved into position behind the legs 12 and 14. Legs 16 and 18 are then reextended so that all the legs are engaging and supporting the mine roof R.

Figure 5:
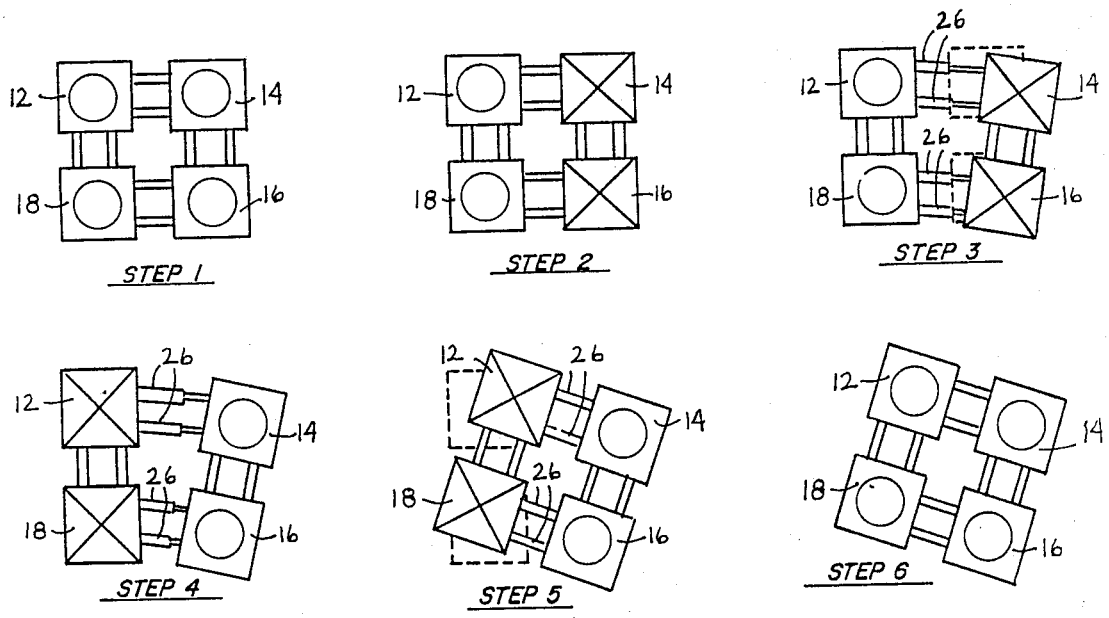
FIG. 5 is a diagrammatical representation showing rotation of the apparatus to allow diagonal movement.

As should be appreciated from viewing FIG. 5, the apparatus may also be turned to move in a diagonal direction. For example, as shown in step 2, legs 14 and 16 are retracted. The rams 26 extending between the legs 12 and 14 are then fully extended while the rams 26 extending between the legs 18 and 16 are partially extended. This serves to move the legs 14 and 16 from the dashed line to the full line position shown in step 3 of FIG. 5.

Once so positioned, the legs 14 and 16 are reextended to engage the floor and roof of the mine. Next, the legs 12 and 18 are retracted and the rams 26 extending between the legs 12 and 14 and 18 and 16, respectively, are retracted. This serves to move the legs 12 and 18 from the dash line to full line position shown in step 5 of FIG. 5. There, the legs 12 and 18 are reextended.

If desired, the same procedure may again be followed from this point to further turn the apparatus 10. Alternatively, the apparatus 10 may then be moved in a linear direction if desired as demonstrated above and as shown in FIG. 4. Of course, it should also be appreciated that the apparatus 10 may be turned in the opposite direction to that described in FIG. 5 if desired. In fact, it is clear that the apparatus 10 may be turned to substantially any angle and moved in substantially any direction about a 360° arc. Advantageously, the apparatus may thus be directly moved in the mine to substantially any desired position as may be required to move around mine equipment, pillars or other obstacles and provide roof support.

Figure 8:
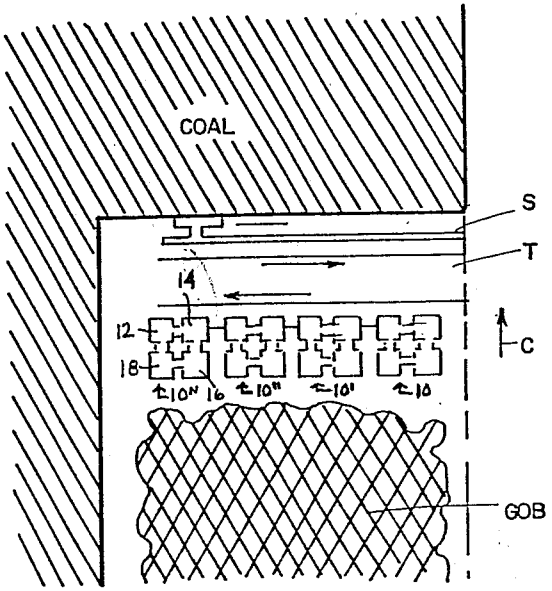
FIGS. 7 and 8 are schematical representations showing utilization of the apparatus of the present invention in various mining schemes.
Figure 7:
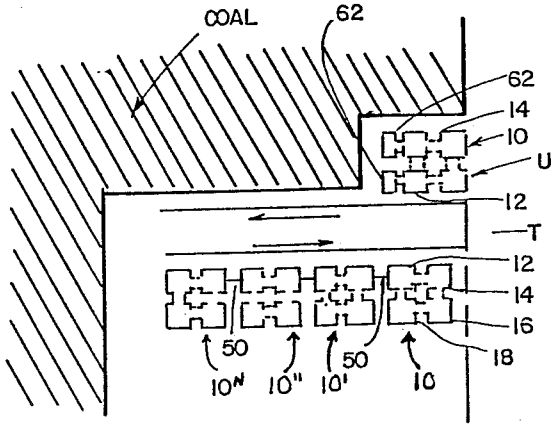

As best shown in FIG. 3, 7 and 8, a number of the apparatus 10 described above may be connected together in series so as to form a line for roof support. In particular, such a line of roof support may be utilized to follow along behind a shearer S and face conveyor T as shown in FIG. 8 in the manner of a longwall operation. Thus, as the continuous miner S and face conveyor T are advanced in the direction of action arrow C, a line of apparatus 10 are also advanced with the roof left to fall as gob on the back side of the mining operation. Alternatively, as shown in FIG. 7, the line of apparatus 10 may be utilized to follow behind a face conveyor T being utilized in conjunction with a continuous miner U in the manner of a shortwall operation.

When a series of apparatus 10 are connected together to form a line for roof support, it is important that the movements of the individual apparatus in the line be coordinated. In particular, it is necessary for the microprocessor controller 36 to be able to sense the relative position of each of the individual apparatus 10. In order to achieve this end, a position sensing wand 50 extends between one leg of each of the adjacent apparatus 10. As best shown in FIG. 3, the telescoping connecting wand 50 extends, for example, between the leg 12 of the first mining apparatus 10 and the leg 14 of the second mining apparatus 10'. Sensors 52 connected to the wand 50 sense not only the length but the vertical angle and horizontal angle of the wand at one of the U-joints 54 through which the wand is connected to the legs 12, 14. This sensed information is then fed to the microprocessor 36, thereby providing the necessary information for the microprocessor to coordinate the movements of any number of individual apparatus 10, 10', . . . , 10$^n$ in the roof support line.

As also shown in FIG. 3, one or more of the apparatus 10 may be connected to a face conveyor 56 by means of support arms 58 connecting the bottom portion 20 of the shields of legs 14 to the tray 60 of the face conveyor. Thus, for example, as the line of units 10 are moved forward (note action arrow G) toward the coal face in a coordinated manner, the conveyor 56 is also moved forward.

As shown schematically in FIG. 7, it should also be appreciated that a mining machine, such as a continuous miner head, pneumatic hammer or pneumatic breaker 62 may be mounted to a leg of an apparatus 10. Thus, for example, a pneumatic breaker 62 may be mounted to each of the fore legs 12, 14 as shown schematically in FIG. 7. Movement of the apparatus 0 is then controlled as described above so as to bring the mining machine 62 into engagement with the coal which is then cut and/or broken for recovery.

In order to ensure that the apparatus 10 is moved as desired, the apparatus may also be equipped with a TV camera and/or gamma ray detector 64. Either of these devices may be utilized to detect and determine the position of the coal face as well as the floor and roof of the mine. This information may then be utilized to guide the apparatus 10 to the desired position for roof support and/or conveyor or mining machine positioning. Thus, the apparatus may be utilized to provide extremely efficient mining. Further, where relatively short shields 20, 22 are utilized, efficient mining of thin seams is possible.

In summary, numerous benefits have been described which result from employing the concepts of the present invention. The apparatus 10 of the present invention is extremely versatile and may be utilized to provide roof support as desired. Alternatively, a coal conveyor 56 or mining machine 62 may be mounted to an apparatus 10 which may then be utilized to move the conveyor or mining machine into any desired position for recovering coal. The mining apparatus may be utilized in certain situations as a substitute for surface mining. In other situations it may be utilized in conjunction with surface mining to recover coal remaining in the ground after the overburden has become too deep for surface mining to be economically feasible. Advantageously, the apparatus 10 may also be utilized to fully provide or supplement the roof support along a longwall or shortwall mining operation. In addition, the apparatus may be utilized to help recover pillars of coal during retreat along a room and pillar mining stretch.

It should also be appreciated that the apparatus is relatively inexpensive to build, yet is extremely valuable to the operator because of its versatility. In effect, the apparatus 10 may be utilized to provide a high rate of coal recovery under a number of different mining conditions in a safe and effective manner by allowing remote operation from a position of relative safety.

The foregoing description of a preferred embodiment of the invention has been presented for purposes of illustration and description. It is not intende to be exhaustive or to limit the invention to the precise form disclosed. Obvious modifications or variations are possible in light of the above teachings. For example, a single apparatus can be manually controlled. In addition, a cover formed of, for example, a flexible rubber material may be provided to prevent debris from falling from the mine roof into the area between the legs. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

I claim:

1. A mining apparatus for utilization in recovering coal from a coal seam, comprising:

a series of cooperating support legs;

means for selectively extending and retracting said support legs between a floor and a roof of said coal seam;

said series of support legs including at least a left foreleg, right foreleg left rear leg, and right rear leg, wherein each of said support legs are separately engageable with said mine roof;

means for moving said support legs relative to one another so that said apparatus may be directly moved in substantially any selected direction about a 360° arc while maintaining roof support; and means for controlling operation of said apparatus.

2. The mining apparatus set forth in claim 1, wherein each of said support legs includes an inflatable bag.

3. The mining apparatus set forth in claim 2, wherein said extending and retracting means includes a pressurized fluid source and a fluid flow control means connected to said inflatable bag.

4. The mining apparatus set forth in claim 3, wherein said inflatable bag is formed in an accordian shape.

5. The mining apparatus set forth in claim 3 wherein said flow control means includes a valve responsive to said controlling means.

6. The mining apparatus set forth in claim 1, wherein said moving means includes a first actuator connecting said left and right forelegs, a second actuator connecting said right fore and rear legs, a third actuator connecting said left and right rear legs and a fourth actuator connecting said left fore and rear legs.

7. The mining apparatus set forth in claim 6, wherein said first, second, third and fourth actuators are hydraulic rams.

8. The mining apparatus set forth in claim 7, wherein a second pressurized fluid source and a second flow control means are connected to said hydraulic rams, said second pressurized fluid source and second flow control means being responsive to said controlling means to move said legs independently of one another so that said apparatus may be moved in substantially any direction about a 360° arc.

9. The mining apparatus set forth in claim 1, further comprising means for connecting multiple mining apparatus together to form a line for roof support and means for sensing the relative position of said multiple mining apparatus connected together.

10. The mining apparatus set forth in claim 9, wherein said position sensing means includes a telescoping connecting wand connected to adjacent mining apparatus by means of U-joint connectors.

11. The mining apparatus set forth in claim 10, wherein sensors are provided for sensing length, vertical angle and horizontal angle of said wand, said sensor serving to feed this information to said controlling means.

12. The mining apparatus set forth in claim 1, further comprising coal conveying means connected to said apparatus for movement therewith.

13. The mining apparatus set forth in claim 1, further including coal cutting means connected to said apparatus to cut coal from the seam as said apparatus is advanced into the seam.

14. The mining apparatus set forth in claim 13, wherein is provided means for detecting the face, floor and ceiling of said seam so as to allow control of mining.

* * * * *